US006288488B1

(12) United States Patent
Amemiya

(10) Patent No.: US 6,288,488 B1
(45) **Date of Patent: *Sep. 11, 2001**

(54) PLASMA DISPLAY PANEL HAVING PARTICULAR STRUCTURE OF ELECTRODES

(75) Inventor: Kimio Amemiya, Yamanashi-ken (JP)

(73) Assignee: Pioneer Electronic Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/187,740

(22) Filed: Nov. 9, 1998

(30) Foreign Application Priority Data

Nov. 13, 1997 (JP) ..... 9-329533

(51) Int. Cl.[7] ..... H01J 17/49
(52) U.S. Cl. ..... 313/582; 583/584; 583/586
(58) Field of Search ..... 313/582, 583, 313/584, 585, 587, 479

(56) References Cited

U.S. PATENT DOCUMENTS 4,703,225 * 10/1987 Sohn ..... 313/587
5,754,003 * 5/1998 Murai et al. ..... 313/582
5,789,862 * 8/1998 Makino ..... 313/584
5,962,974 * 10/1999 Komaki et al. ..... 313/582

* cited by examiner

*Primary Examiner*—Nimeshkumar D. Patel
*Assistant Examiner*—Karabi Guharay
(74) *Attorney, Agent, or Firm*—Arent Fox Kintner Plotkin & Kahn, PLLC

(57) ABSTRACT

A plasma display panel comprises a front substrate plate providing a display surface; a plurality of row electrode pairs formed on an inner surface of the front substrate plate; a dielectric layer formed on the plurality of row electrode pairs; a protection layer formed on the dielectric layer; a rear substrate plate spaced apart from the front substrate plate with a discharge space formed therebetween; a plurality of column electrodes formed on an inner surface of the rear substrate layer, arranged in a direction orthogonal to the row electrode pairs; a plurality of elongated partitions disposed between the plurality of column electrodes; a fluorescent layer of various colors, covering the column electrodes and elongated partitions; a plurality of color filter layers formed on the inner surface of the front substrate layer. In particular, each row electrode pair includes a pair of elongated main body portions and a plurality of projection pairs. Each projection pair is formed by a transparent conductive film and is isolated in one unit luminescent area, while each elongated main body portion is formed by a metal film and is overlapped on an edge of the transparent conductive film opposite to a discharge gap.

6 Claims, 3 Drawing Sheets

PLASMA DISPLAY PANEL HAVING PARTICULAR STRUCTURE OF ELECTRODES

BACKGROUND OF THE INVENTION

The present invention relates to a plasma display panel, in particular to a surface discharge type plasma display panel.

Recently, there has been a demand that a surface discharge type plasma display panel be put into actual use, i.e., for use as a color display device which is large in size but small in thickness. FIG. 6 is a plane view schematically illustrating the structure of a conventional surface discharge type plasma display panel. FIG. 7 is a cross sectional view schematically indicating the internal structure of the plasma display panel of FIG. 6.

Referring to FIG. 6, the conventional plasma display panel has a plurality of row electrode pairs 2, 2, each arranged along a display line L of a matrix array on the panel, in a manner such that each electrode pair 2, 2 has a discharge gap 11 formed therebetween. Further, along each display line L, there are formed several unit luminescent areas, each of which forms a picture element cells (discharge sell).

FIG. 7 is a cross sectional view taken along a line V—V in FIG. 6, illustrating some important portions of the conventional display panel of FIG. 6. As shown in FIG. 7, formed on the inner side of a front glass substrate 1 (serving as a front display plate), are a plurality of color filter layers 41R, 41G, 41B each consisting of an inorganic pigment material, a transparent overcoat 42 covering the color filter layers 41, a plurality of row electrode pairs 2, 2, a dielectric layer 3 covering the row electrode pairs 2, 2, a protection layer 4 consisting of MgO for covering the dielectric layer 3.

Each row electrode 2 includes a transparent electrode 2*a* consisting of a belt-like transparent conductive film of ITO having a relatively large width, and a metal electrode (bus electrode) 2*b* consisting of a metal film having a relatively small width. The metal electrode 2*b* is used to supplement the conductivity of the transparent electrode 2.

On the other hand, a rear glass substrate 5 is positioned spaced apart from the front glass substrate 1 so that a discharge space 8 is formed between the two substrates. As shown in FIG. 7, a plurality of column electrodes 6 are provided on the inner surface of the rear glass substrate 5 in a manner such that they are all orthogonal to the row electrode pairs 2, 2. In fact, each intersection of the row electrode pairs 2, 2 with a column electrode 6 forms a picture element cell. Further, a plurality of belt-like partitions 9 are provided between the column electrodes 6, so that the discharge space 8 is divided into several sections. In addition, a plurality of fluorescent layers (7R, 7G, 7B) are disposed in the discharge space 8 to cover the column electrode 6 and the partitions 9. Finally, after a noble gas is sealed into the discharge space 8, a plasma display panel is thus formed.

In use of the surface discharge type plasma display panel constructed in the above prior art, at first, an addressing process is performed by selected discharges between the column electrodes 6 and the row electrodes 2, so as to select lighting cells (in which wall charges are formed) and not-lighting cells (in which wall charges are not formed). After the addressing process, by alternatively applying discharge maintaining pulses to the row electrode pairs 2, 2 on all the display lines L, a surface discharge will occur every time the discharge maintaining pulses are applied to the lighting cells. Then, with the effect of the surface discharge, an ultraviolet light will occur, so that the fluorescent layer 7 is excited, thereby producing a visible light.

Conventionally, in order to improve a contrast and a color fineness of a surface discharge type plasma display panel, color filter layers 41R, 41G, 41B are usually provided on the inner surface of the front glass substrate 1, as shown in FIG. 7. However, if several color filter layers 41R, 41G, 41B are disposed on the inner surface of a front glass substrate 1, these color filters 41 are difficult to be made uniform in their thickness, because different color filter layers are usually manufactured with different requirements and have different optical characteristics. As a result, some irregularities will occur on the inner surface of the front glass substrate 1. To eliminate such irregularities, an overcoat layer 42 is often formed to cover up these color filters 41, but still fails to obtain a smooth and flat surface, unavoidably producing some shouldered portions of several microns. Consequently, as shown in FIG. 7, some undesired gaps 50 will be formed, resulting in a problem that a discharge in one cell will undesirably spread to an adjacent cell through such gap 50, hence causing a wrong discharge.

SUMMARY OF THE INVENTION

It is an object of the present invention to provide an improved plasma display panel which involves the use of color filters for improving a contrast and a color fineness but is capable of preventing a wrong discharge and further has an enlarged display margin, so as to solve the above-mentioned problems peculiar to the above-mentioned prior art;

According to the present invention, there is provided a plasma display panel comprising: a front substrate plate providing a display surface; a plurality of row electrode pairs formed on an inner surface of the front substrate plate, each row electrode pair including a pair of elongated main body portions extending in a horizontal direction, a plurality of projection pairs, each projection pair being formed in a unit luminescent area and protruding toward each other in a vertical direction with a discharge gap formed therebetween; a dielectric layer formed on the plurality of row electrode pairs; a protection layer formed on the dielectric layer; a rear substrate plate spaced apart from the front substrate plate with a discharge space formed therebetween; a plurality of column electrodes formed on an inner surface of the rear substrate layer, said column electrodes being arranged in a direction orthogonal to the row electrode pairs; a plurality of elongated partitions disposed between the plurality of column electrodes; a fluorescent layer of various colors, covering the column electrodes and elongated partitions; a plurality of color filter layers formed on the inner surface of the front substrate layer, said color filter layers corresponding to the fluorescent layer of various colors. In particular, each projection pair is formed by a transparent conductive film and is isolated in one unit luminescent area, while each elongated main body portion is formed by a metal film and is overlapped on an edge of the transparent conductive film opposite to a discharge gap.

In one aspect of the present invention, each projection of a projection pair is formed into a T-shape element including a large-width portion and a narrow-width portion.

In another aspect of the present invention, some surface areas of the dielectric layer formed corresponding to the elongated main body portions of the row electrode pairs are projected with respect to other portions of the dielectric layer.

In one more aspect of the present invention, the protection layer is formed by a secondary electron emission material, covering most surface areas of the dielectric layer except those formed corresponding to the elongated main body portions of the row electrode pairs.

In one more aspect of the present invention, the protection layer is formed by a secondary electron emission material, covering most surface areas of the dielectric layer except those formed corresponding to the elongated partitions.

In one more aspect of the present invention, some surface areas of the dielectric layer formed corresponding to the elongated partitions are projected with respect to other portions of the dielectric layer.

The above objects and features of the present invention will become better understood from the following description with reference to the accompanying drawings.

DETAILED DESCRIPTION OF THE PREFERRED EMBODIMENTS

Figure 1:
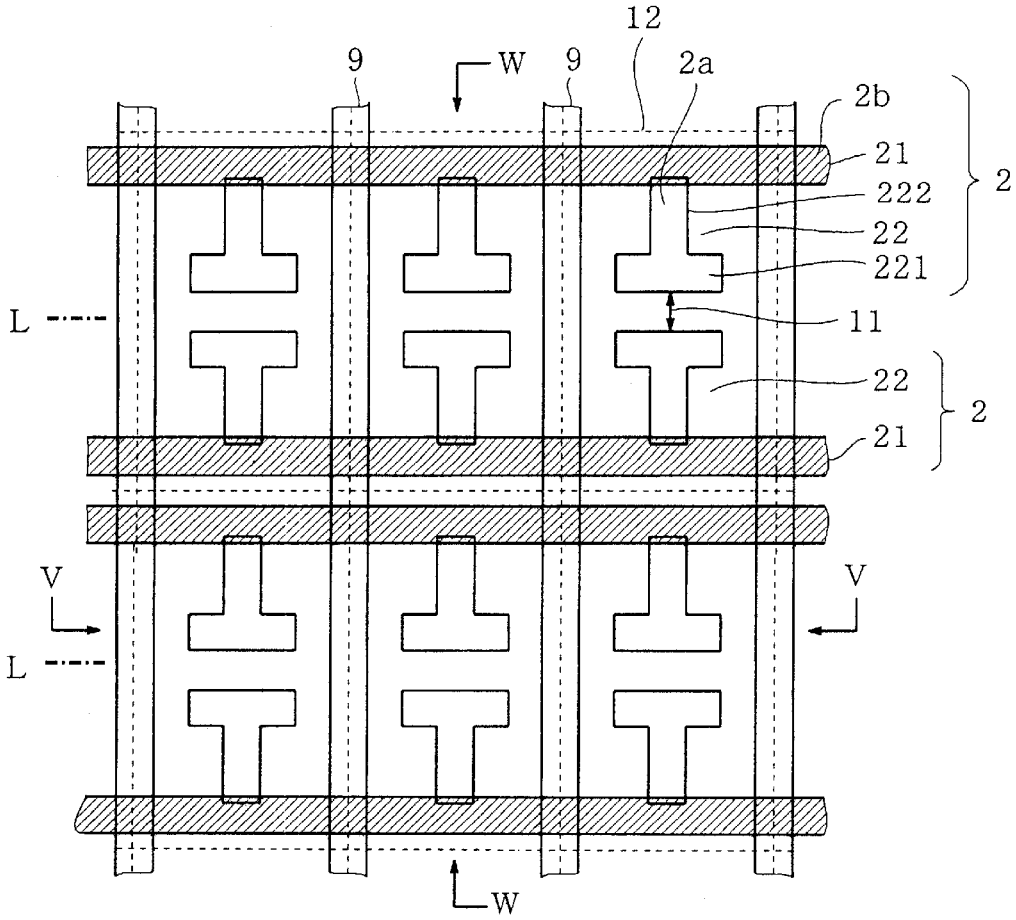
FIG. 1 is an enlarged plane view indicating a plasma display panel made according to an embodiment of the present invention.

In the following description of preferred embodiments of the present invention, the elements which are the same as those used in the above prior art will be represented by the same reference numerals, and similar descriptions thereof will be omitted.

Figure 2:
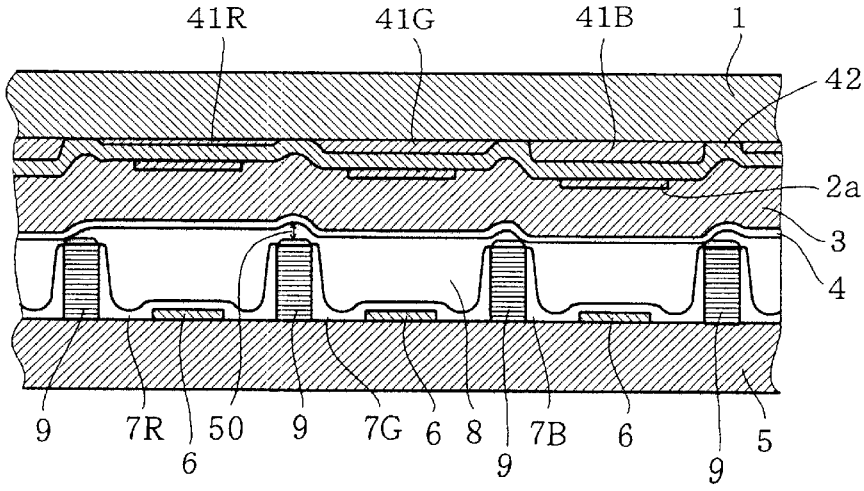
FIG. 2 is a cross sectional view taken along a line V—V in FIG. 1.
Figure 3:
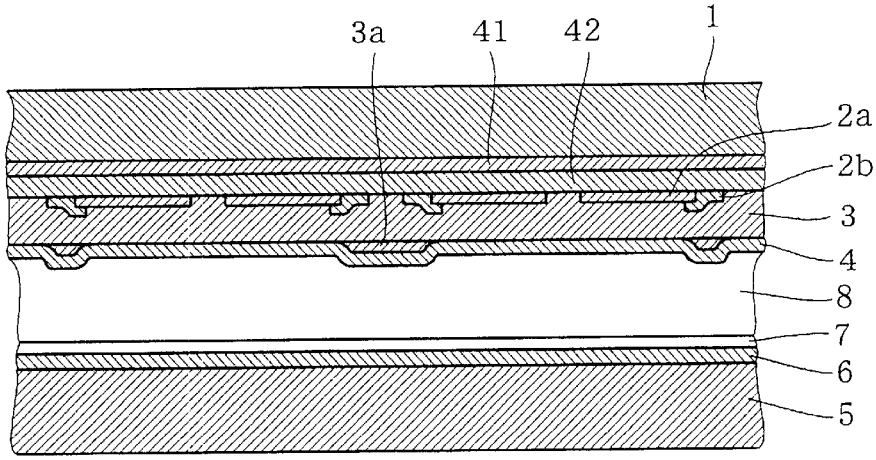
FIG. 3 is a cross sectional view taken along a line W—W in FIG. 1.

FIGS. 1–3 indicate a surface discharge type plasma display panel made according to an embodiment of the present invention.

FIG. 1 is an enlarged plan view indicating the plasma display panel. Referring to FIG. 1, each pair of row electrodes 2, 2 include two elongated main body portions 21, 21 which are elongated belt-like members arranged in parallel with display lines L, a plurality of projection pairs 22, 22. Each projection pairs 22, 22 are arranged facing each other form a discharge gap 11 therebetween. Each projection 22 includes a wide-width portion 221 and a narrow-width portion 222. In detail, each projection 22 is formed by a transparent electrode 2*a* consisting of a T-shaped transparent conductive film, and is overlapped with an elongated main body portion 21 formed by a metal electrode 2*b* consisting of a metal film.

FIGS. 2 and 3 are cross sectional views indicating the internal structure of the plasma display panel of FIG. 1. In detail, FIG. 2 is a cross sectional view taken along a line V—V in FIG. 1, FIG. 3 is a cross sectional view taken along a line W—W in the same figure. In fact, the plasma display panel of the present embodiment is an AC-driven surface discharge type plasma display panel.

As shown in FIGS. 2 and 3, formed on the inner surface of a front glass substrate plate 1 (providing a display surface), are a plurality of color filter layers 41R, 41G, 41B each consisting of an inorganic pigment, a transparent overcoat 42 covering these color filter layers 41, a plurality of row electrode pairs 2, 2, a dielectric layer 3 covering the row electrode pairs 2, 2, a protection layer 4 consisting of magnesium oxide (MgO) for covering the dielectric layer 3. Here, some surface areas of the dielectric layer 3 formed corresponding to elongated main body portions 21, 21 (including elongated areas between adjacent portions 21, 21) of row electrode pairs 2, 2 are projected with respect to portions of the dielectric layer 3, thus forming a plurality of projections 3*a*. Such projections 3*a* are proved to be effective in preventing discharge interference in the direction of column electrodes.

On the other hand, a rear glass substrate plate 5 is positioned spaced apart from the front glass substrate plate 1 so that a discharge space 8 is formed between the two substrate plates. Further, a plurality of elongated belt-like partitions 9 are provided on the inner surface of the rear glass substrate plate 5, so that the discharge space 8 is divided into a plurality of unit luminescent areas 12 along the direction of the display lines L. As shown in FIG. 2, a plurality of column electrodes 6 are provided on the inner surface of the rear glass substrate plate 5 in a manner such that they are all orthogonal to the row electrodes 2. In addition, a plurality of fluorescent layers (7R, 7G, 7B) are disposed in the discharge space 8 to cover the column electrodes 6 and the elongated partitions 9.

In this way, when the color filter layers 41 are formed in positions, each pair of transparent electrodes 2*a*, 2*a* will be enclosed and isolated in each unit luminescent area 12, thus, even if a gap 50 (FIG. 2) is formed between a partition wall 9 and the protection layer 4, it is sure to prevent a discharge spreading in the direction of the row electrodes.

Further, since irregularities caused by color filter layers 41 are allowed to have larger values than prior art, a display margin has become larger, thus, some relevant requirements has become not so severe as before in a process for making flat and smooth for a display panel, thereby it is allowed to increase the yield of display panel production and reduce production cost.

Figure 4:
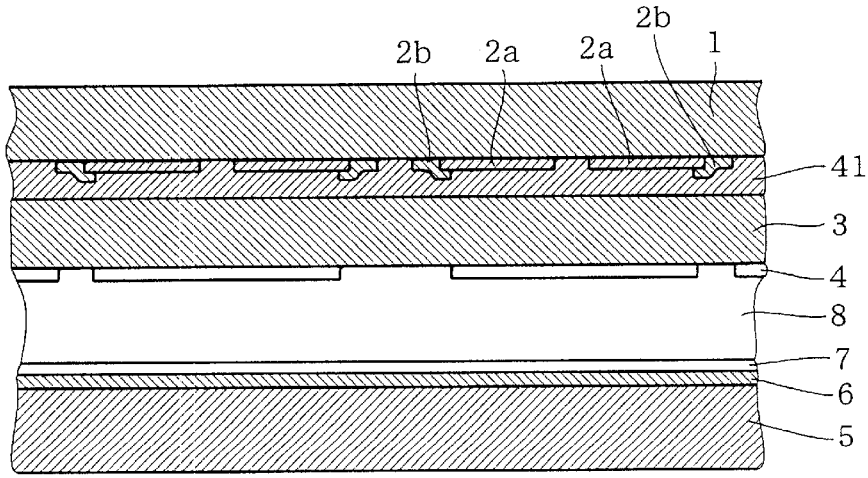
FIG. 4 is a cross sectional view indicating a plasma display panel made according to another embodiment of the present invention.

Although it has been described in the above embodiment that some surface areas of the dielectric layer 3 formed corresponding to elongated main body portions 21, 21 (including elongated areas between adjacent portions 21, 21) of row electrode pairs 2, 2 are projected with respect to other portions of the dielectric layer 3, it is also possible that some surface areas of the dielectric layer 3 are not covered by a protection layer 4 formed by secondary electron discharge material such as MgO, in a manner as shown in FIG. 4, so as to obtain a similar effect. In other words, the protection layer 4 may be formed by a secondary electron emission material, covering most surface areas of the dielectric layer 3 except those formed corresponding to the elongated main body portions 21 of the row electrode pairs 2.

Figure 5:
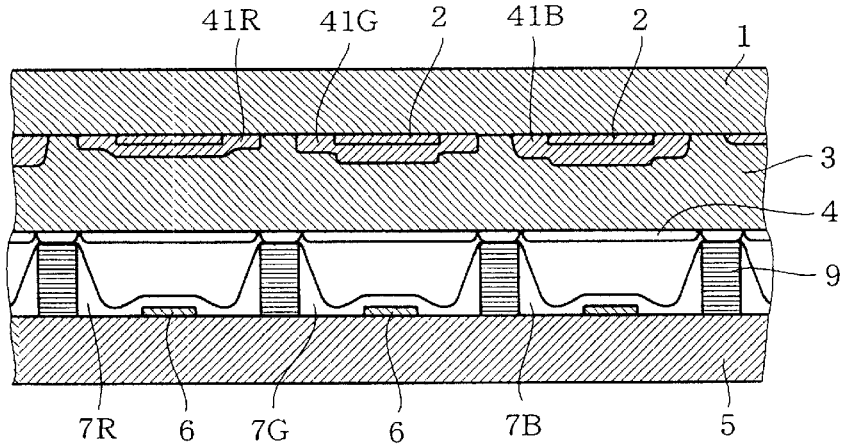
FIG. 5 is a cross sectional view indicating a plasma display panel made according to a further embodiment of the present invention.
Figure 6:
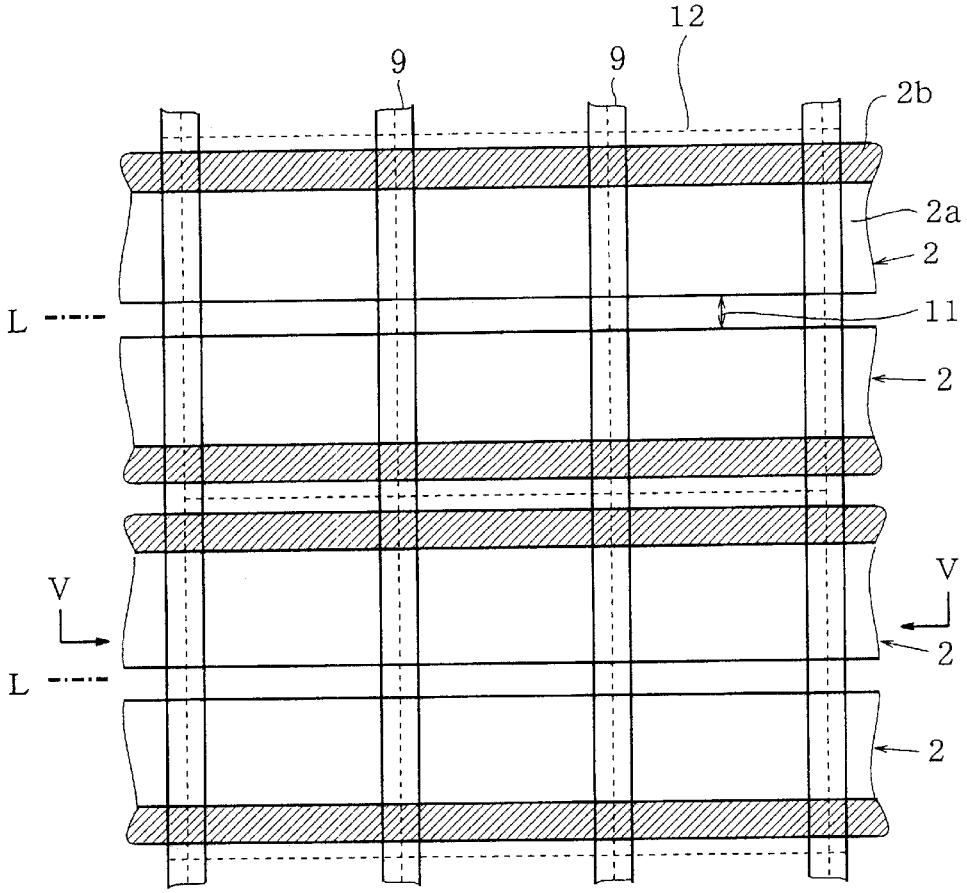
FIG.6 PRIOR ART
FIG. 6 is an enlarged plane view indicating a plasma display panel made according to a prior art.
Figure 7:
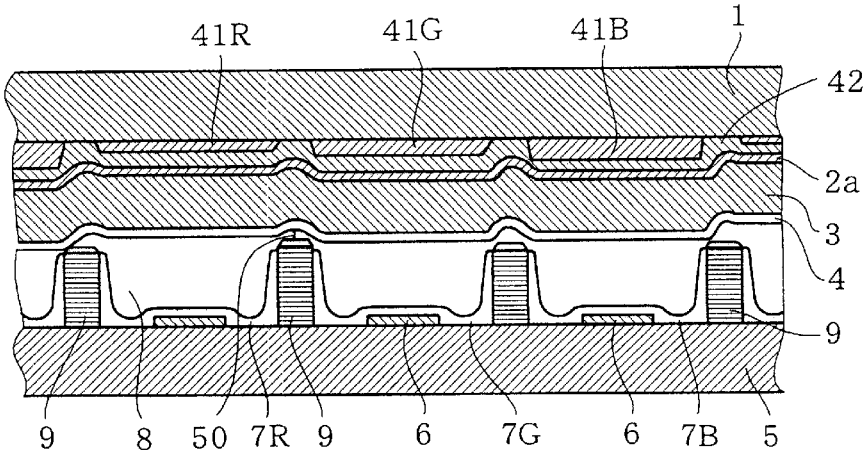
FIG.7 PRIOR ART
FIG. 7 is a cross sectional view indicating an internal structure of the plasma display panel of FIG. 6.

Further, although it has been described in the above embodiment that the color filter layers 41 are interposed between the front glass substrate plate 1 and the row electrode pairs 2, it is also possible that the color filter layers 41 may be interposed between the row electrode pairs 2 and the dielectric layer 3, or between the dielectric layer 3 and the protection layer 4, as shown in FIG. 5.

In addition, as shown in FIG. 5, it is also possible that there are no protection layers 4 (consisting of secondary electron discharge material) formed on some areas of the dielectric layer 3 formed corresponding to the elongated partitions 9, or alternatively, some areas of the dielectric layer 3 formed corresponding to the elongated partitions 9 are formed to project with respect to other portions of the dielectric layer 3, so as to exactly prevent discharge spreading in the direction of the row electrodes. In other words, the protection layer 4. may be formed by a secondary electron emission material, covering most surface areas of the dielectric layer 3 except those formed corresponding to the elongated partitions 9, and, some surface areas of the dielectric layer 3 formed corresponding to the elongated partitions 9 are projected with respect to other portions of the dielectric layer 3, thereby obtaining a similar effect as in the above first embodiment.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A plasma display panel comprising:

a front substrate plate providing a display surface;

a plurality of row electrode pairs formed on an inner surface of the front substrate plate, each row electrode pair including a pair of elongated main body portions extending in a horizontal direction, a plurality of projection pairs, each projection pair being formed in a unit luminescent area and protruding toward each other in a vertical direction with a discharge gap formed therebetween;

a dielectric layer formed on the plurality of row electrode pairs;

a protection layer formed on the dielectric layer;

a rear substrate plate spaced apart from the front substrate plate with a discharge space formed therebetween;

a plurality of column electrodes formed on an inner surface of the rear substrate layer, said column electrodes being arranged in a direction orthogonal to the row electrode pairs;

a plurality of elongated partitions disposed between the plurality of column electrodes;

a fluorescent layer of various colors, covering the column electrodes and elongated partitions;

a plurality of color filter layers formed on the inner surface of the front substrate layer, said color filter layers corresponding to the fluorescent layer of various colors;

wherein each projection pair is formed by a transparent conductive film and is isolated in one unit luminescent area, while each elongated main body portion is formed by a metal film and is overlapped on an edge of the transparent conductive film opposite to a discharge gap.

2. The plasma display panel according to claim 1, wherein each projection of a projection pair is formed into a T-shape element including a large-width portion and a narrow-width portion.

3. The plasma display panel according to claim 1, wherein some surface areas of the dielectric layer formed corresponding to the elongated main body portions of the row electrode pairs are projected with respect to other portions of the dielectric layer.

4. The plasma display panel according to claim 1, wherein the protection layer is formed by a secondary electron emission material, covering most surface areas of the dielectric layer except those formed corresponding to the elongated main body portions of the row electrode pairs.

5. The plasma display panel according to claim 1, wherein the protection layer is formed by a secondary electron emission material, covering most surface areas of the dielectric layer except those formed corresponding to the elongated partitions.

6. The plasma display panel according to claim 1, wherein some surface areas of the dielectric layer formed corresponding to the elongated partitions are projected with respect to other portions of the dielectric layer.

* * * * *